United States Patent [19]

Monte

[11] 4,291,715

[45] Sep. 29, 1981

[54] FOOT SUPPORT CRUTCH

[76] Inventor: Woodrow S. Monte, 19 Hollywood Dr., Bricktown, N.J. 08723

[21] Appl. No.: 118,487

[22] Filed: Feb. 4, 1980

[51] Int. Cl.[3] ..... A61H 3/02

[52] U.S. Cl. ..... 135/68

[58] Field of Search ..... 135/65–69; 297/5, 6; 248/155; 272/70.1–70.3

[56] References Cited

U.S. PATENT DOCUMENTS

| | | | |
|---|---|---|---|
| 3,016,060 | 1/1962 | Beattie | 135/68 |
| 3,999,565 | 12/1976 | Delacour et al. | 135/65 |
| 4,141,375 | 2/1979 | Tykwinski | 135/68 X |

FOREIGN PATENT DOCUMENTS

| | | | |
|---|---|---|---|
| 497013 | 8/1919 | France | 135/68 |
| 2267750 | 11/1975 | France | 135/67 |
| 593340 | 10/1947 | United Kingdom | 135/66 |

*Primary Examiner*—J. Karl Bell

[57] ABSTRACT

There is disclosed a lower leg or foot support crutch having a cushion support for engaging the leg below the knee and for transmitting the forces applied through the cushion directly downward to a ground engaging leg. In one embodiment there is shown a dual ground support arrangement having level seeking ability for the leg supports.

11 Claims, 6 Drawing Figures

FOOT SUPPORT CRUTCH

FIELD OF THE INVENTION

This invention is directed to a crutch for use by people with infimaties and more particularly to a special support crutch useful for those having foot and lower leg injuries.

BACKGROUND OF THE INVENTION

Over the course of the years there have been known many types of crutches or walking aids each having a design unique to a particular type of infirmity. These have served their purpose well and each has been touted as being able to handle a variety of medical problems. For the most part these crutches have assumed that the leg with which they are to be used can support little or no weight. Thus, for a broken leg the object is to remove the body weight as much as possible from the leg or foot thereby allowing the broken bone to heal. The same is true for tissue damage where it is desired to remove the leg from its function of body support. The crutch then substitutes for the leg and in the typical situation body support is transferred to the shoulder joint.

Some crutches have been designed, as has that shown in the J. W. Beattle U.S. Pat. No. 3,016,060 dated Jan. 9, 1962, for use by amputees for the purpose of supporting the body while in a standing position. While the Beattle patent serves its intended purpose of stationary support it has a serious drawback, as does all prior crutches, when it is desired to use such a crutch for mobility. The problem stems primarily from the fact that for those with lower leg or foot problems only that portion of the leg or foot that is affected should be removed from the individual's support process. To accomplish this result it is necessary to use the upper leg in a manner which allows movement without the risk of slippage. While the Beattle patent solves the partial support problem it fails to allow for safe non-slip movement. The problem, I have discovered, is that all such known partial support crutches have an alarming and regular tendency to slip outward causing serious falls and injuries.

SUMMARY OF MY INVENTION

I have solved the problem of a non-slip lower leg and foot walking crutch by designing the crutch with a leg support platform shaped to fit the leg just below the knee. I have advantageously attached the platform, not to the side arm support portion, as has been done in the past, but rather the platform is supported directly by the ground by a support which extends substantially directly downward from the support to the ground. In this manner, when pressure is placed on the support by the user this pressure (or force) is transmitted straight downward and little, if any, sideward force component is generated. In my illustrative embodiment the arm piece is used merely as an aid to balance and plays no function in the actual body support process.

In use, the user merely bends the leg backward (as opposed to forward for use of the Beattle device), supports the leg on the curved platform, places the arm upright piece under the shoulder joint and walks, using the upper leg and thigh for support, while keeping the lower leg and foot immobile.

In one embodiment of my invention ground support is provided by a single member, while in another embodiment ground support is provided by a dual member fashioned to contact the ground in two places. As a further embodiment I have arranged the dual support with a device for leveling so that the crutch will remain upright when used on uneven or hilly terrain.

Thus it is one feature of my invention to provide a lower leg and foot support crutch having direct downward pressure from a leg support platform.

It is also a feature of may invention to provide such a direct downward bearing support crutch having a dual support base as well as with a dual support base having a device for self-leveling of at least one of the support legs.

DRAWING

These and other features and advantages of my invention will become more apparent from a review of one illustrative embodiment of my invention in which.

DETAILED DESCRIPTION

Figure 1:
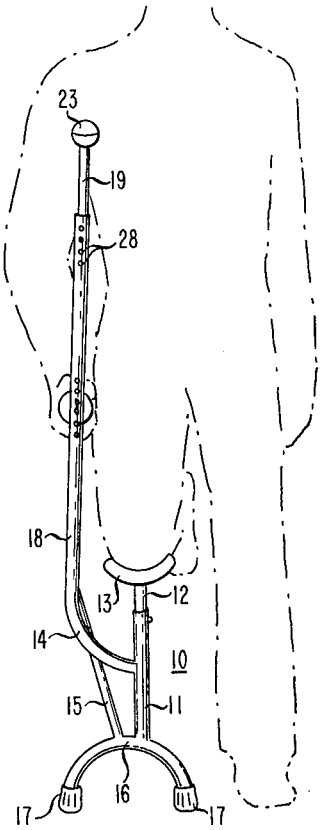
FIG. 1 shows the leg support crutch having a duel base.
Figure 3:
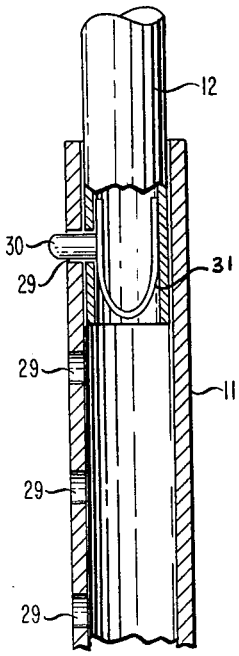
FIG. 3 shows a device for adjusting the heights of the various parts of the crutch.

Shown in FIG. 1 is my dual support lower leg and foot crutch 10. As can be seen the user simply bends the leg backward at the knee and places the upper portion of the lower leg into cushion support platform 13. Cushion 13 is in turn supported by support member 12, which may be a hollow pipe, which in turn is supported by support member 11. When support member 11 is also a hollow pipe it should be constructed with a diameter slightly larger than that of support member 12 so that one of the members may run inside the other. In such an arrangement, as shown in FIG. 3, by arranging holes, such as holes 29, in the members, an adjusting pin, such as pin 30, can be used to adjust the height of cushion leg support 13. Pin 30 may be a simple bolt through the holes or it may be, as shown, a spring loaded pin held in place by spring 31 forcing pins 30 outward through the holes. For adjustment the pins are held in by finger pressure and relative position of the pipes moved.

Continuing in FIG. 1 it will be seen that support 12 is held rigid by support 11, this combination is the intermediate support device and in turn is supported by lower or ground support member 16 which has two ground contact ends with non-slip caps 17. Thus, when body force is applied to cushioned leg support 13 this force is transmitted directly down through supports 12, 11 and 16 to the ground.

Also connected to ground support 16, by way of brace 15, is arm piece 18 which acts to stabilize the user's body. Arm piece 18 is adjustably connected to support 19 which in turn is connected to cushion 23 for underarm or body support. Stabilizing support 19 is adjustable with respect to support 18 in the same manner as detailed in FIG. 3 for supports 11 and 12.

Hand support 25 (shown in FIG. 2) is adjusted by bolt assembly 26 via holes in arm piece 18. Arm piece 18 is connected to intermediate support 11 by curved piece 14. It will be noted from FIG. 1 that arm piece 18 curves outward from direct weight support piece 11 and as it moved upward gradually tapers closer to the body so that its top end fits properly under the arm. It will also be noted that all force from cushion 13 is transmitted downward with little or no sidewards force vector. This is accomplished by separating cushion 13 entirely from arm piece 18 and by attaching arm piece 18 directly to ground support system 16 so that any force transmitted from the arm or shoulder of the user will also work in conjunction with the downward force from cushion 13 so as to avoid slippage of the crutch. The use of two ground contact points 17 serves to further increase the stability of the device.

Figure 2:
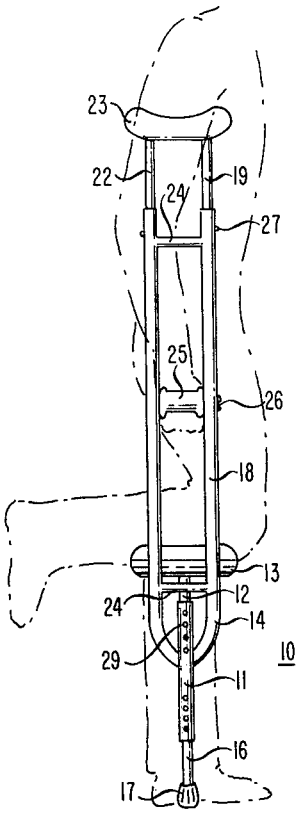
FIG. 2 shows the crutch having a single base.

Shown in FIG. 2 is a single ground contact crutch using the principles of my invention. As in FIG. 1, arm piece 18 is only attached to lower support 11 and not to cushion 13 thereby insuring that all forces are directed downward.

With reference to FIG. 1 brace 15 should be attached to arm piece 18 between the two upright sections, ideally by attachment to a cross support piece, such as support 24 mounted just above curved section 14. On the single structure, (shown in FIG. 2) the bottom end of brace 15 is mounted to the lower end of piece 11. For drawing clarity this has not been shown. Also note that in FIG. 2 piece 16 fits inside piece 11 and is adjusted as shown in FIG. 3.

This crutch may be adjusted easily to fit any person. First the leg is bent backward and cushion 13 is raised or lowered as necessary simply by squeezing on pins 30 and sliding pipe 12 up or down. Next arm piece 23 is fitted under the arm by adjusting support 19 up or down. Finally, hand piece 25 is moved to a confortable position and the user is ready to walk using the adjusted crutch.

Figure 4:
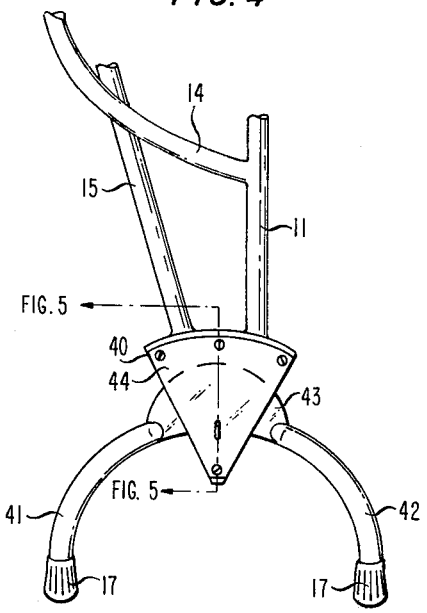
FIG. 4 shows the dual support leg having the self-leveling device.
Figure 5:
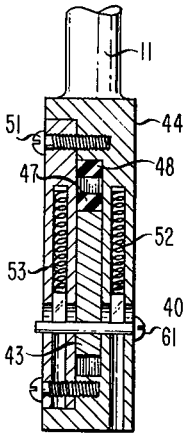
FIG. 5 shows a section view of the self-leveleing device.
Figure 6:
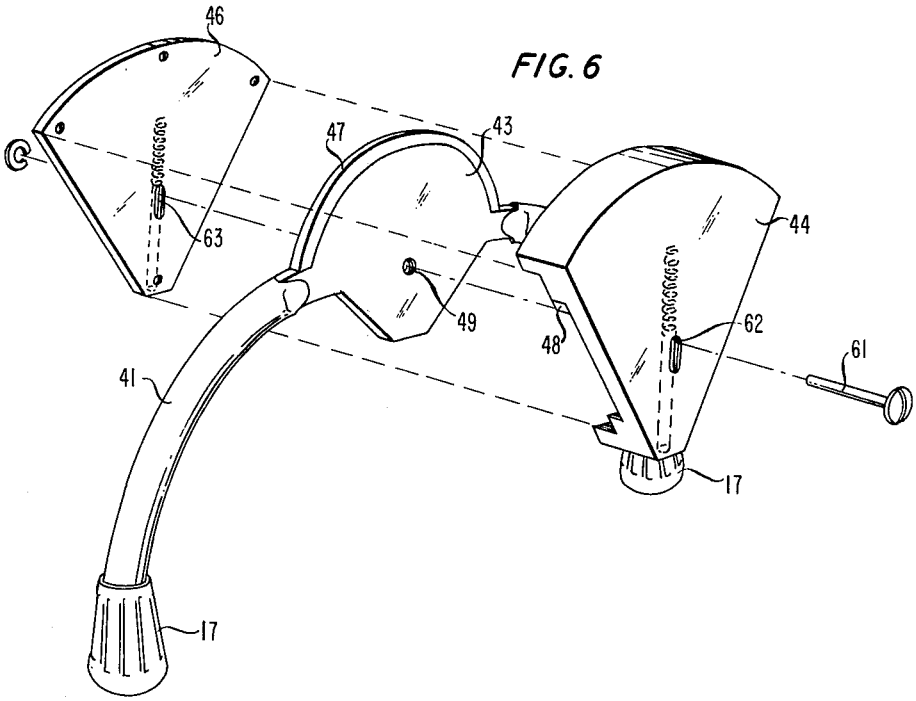
FIG. 6 shows an exploded view of the self-leveling device.

FIG. 4 shows a leveling device for use with the dual support crutch in situations where it is desired to increase even further the stability of the user on rough terrain. Device 40 is substituted for support 16 and has two legs 41 and 42 integral with a clutch member 43. Using this mechanism, shown in exploded view in FIG. 6 and in section in FIG. 5, the ground contact legs are free to seek the proper ground level. Clutch 43 has a top curved surface fitted with a layer 47 of high friction brake material. Side support 44 has constructed inside a corresponding curved section also fitted with high friction brake material 48. Surface 47 rides just under surface 48 and clutch 43 is free to move up and down via elongated slots 62 and 63. When downward force is removed from device 40 springs 52 and 53 which act on pin 61 (FIG. 5) push pin 61 downward which in turn forces clutch 43 downward via hole 49 thereby separating (or reducing the friction between) surfaces 47 and 48. In this situation legs 41 and 42 connected to clutch 43 are free to rotate about pin 61 so that ends 17 may seek the proper ground balance. Pin 61 may be removable or permanently installed.

When downward pressure is exerted on device 40, housing 44 moves downward thereby increasing the friction between surfaces 47 and 48 so as to lock legs 41 and 42 in the position assumed before pressure was applied. In this way the clutch will remain upright even on hilly or uneven terrain.

Note that springs 52 and 53 are contained in holes in side plates 44 and 46 and once in place are retained by pin 61 and also note that while a gap is shown (FIG. 5) between surfaces 47 and 48 it is possible to construct my leveling device without such a gap but in a manner to increase and decrease friction between the two surfaces. Any type of mating material may be used for this purpose including surfaces or a single surface which expands under pressure.

CONCLUSION

While I have shown my crutch with a single and dual bottom it must be understood that several other arrangements may be possible based upon the principal of direct downward support and the elimination of support points which tend to impart outwardly directed forces. Others skilled in the art may tend to improve upon my concept all without departing from the spirit and scope of my invention. Thus, using my concept it should be possible to construct a crutch for animals where the injured leg is bent backward and the upper section is supported by the body of the animal. Such a crutch will tend to prevent further injury to the animal allowing the injured foot to heal properly.

What is claimed is:

1. A lower leg or foot crutch comprising a ground contact member adapted for receiving downwardly applied forces and for transmitting any said applied forces to the ground at a point effectively in line with said applied forces, an intermediate support device having an upper end and a lower end, said lower end connected to said ground contact member and adapted for transmitting forces to said ground contact member through said connection, an upper body stabilizing member having uper and lower ends, said upper end adapted for positioning against a users body, and said lower end connected to said intermediate support device at a position between said lower and upper ends of said intermediate support device, and a leg support member for engaging the leg of a user below the knee thereof, and for accepting downwardly applied forces from said user, said leg support member attached exclusively to said upper end of said intermediate support device for transmitting any said accepted forces directly to said intermedite support device.

2. The device of claim 1 wherein said ground contact member has a plurality of ground contact points and where in said ground contact member is attached to said stabilizing member by a support strut having one end connected to said stabilizing member and a second end attached to said ground contact member.

3. The device of claim 1 wherein said ground contact member comprises first and second ground contact legs, a ground-leveling device interposed between said ground contact legs, said ground leveling device having means for allowing the legs to rotate about an axis, and means controlled by downward pressure for preventing said leg rotation.

4. The invention set forth in claim 3 wherein said ground leveling device rotating means includes a clutch plate having a first friction surface, an outer housing having a second friction surface adapted to mate with said first friction surface, so as to prevent relative movement between said first and second surfaces, and means for separating said first and second surfaces when said downward pressure is removed.

5. The invention set forth in claim 1 further comprising means for adjusting the height of said leg support member independent from the height of said body stabilizing member.

6. A crutch comprising a body stabilizing member having an upper end for engaging the body of the user and a curved lower end, a ground engaging member, an intermediate support device having upper and lower ends, said support connected to said curved lower end of said body stabilizing member at a point along said support intermediate to said upper and lower ends, and a leg support member for accepting the weight of said user, said leg support member attached exclusively to said upper end of said intermediate support device.

7. The device of claim 6 where said intermediate support device is a straight rod.

8. The device of claim 6 wherein said intermediate support device is a plurality of concentric straight pipes adjustable lengthwise therebetween.

9. The device of claim 8 wherein said ground contact member comprises first and second ground contact legs, a ground-leveling device interposed between said ground contact legs, said ground leveling device having means for allowing the legs to rotate about an axis, and means controlled by downward pressure for preventing said leg rotation.

10. The invention set forth in claim 9 wherein said ground leveling device rotating means includes a clutch plate having a first friction surface, an outer housing having a second friction surface adapted to mate with said first friction surface so as to prevent relative movement between said first and second surfaces, and means for separating said first and second surfaces when said downward pressure is removed.

11. A crutch leveling device for use at the base of a leg or foot crutch for stabilizing said crutch on uneven terrain, said device comprising a plurality of legs extending downward from said device and adapted for contact with the ground, a clutch member having means for attaching to said legs, said clutch member rotatable about a pivot point and having a top surface, a friction bearing surface displaced about said top surface, a housing constructed concentric to and surrounding said clutch, said housing having an inner surface adapted for mating relationship with said clutch top surface, said inner surface having a friction bearing surface such that when first and second friction bearing surfaces are in contact with each other rotation of said clutch member is inhibited, means for urging said first and second friction surfaces together when downward pressure is applied to said crutch, and means for reducing the friction between said surfaces when said pressure is removed from said crutch.

* * * * *